US008874020B2

(12) United States Patent
Mita et al.

(10) Patent No.: US 8,874,020 B2
(45) Date of Patent: Oct. 28, 2014

(54) IMAGE FORMING APPARATUS HAVING DECOLORIZING FUNCTION AND SHEET CONVEYING METHOD IN THE IMAGE FORMING APPARATUS

(71) Applicants: Kabushiki Kaisha Toshiba, Minato-ku (JP); Toshiba Tec Kabushiki Kaisha, Shinagawa-ku (JP)

(72) Inventors: Katsutoshi Mita, Izu (JP); Yoshinori Sammonji, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 50 days.

(21) Appl. No.: 13/660,166

(22) Filed: Oct. 25, 2012

(65) Prior Publication Data

US 2013/0108339 A1 May 2, 2013

Related U.S. Application Data

(60) Provisional application No. 61/552,615, filed on Oct. 28, 2011.

(51) Int. Cl.

| | |
|---|---|
| ***G03G 15/20*** | (2006.01) |
| ***G03G 15/16*** | (2006.01) |
| ***G03G 15/01*** | (2006.01) |

(52) U.S. Cl.

CPC ..... *G03G 15/0136* (2013.01); *G03G 15/161* (2013.01); *G03G 15/0189* (2013.01)

USPC ..... 399/341; 399/335

(58) Field of Classification Search

None

See application file for complete search history.

(56) References Cited

U.S. PATENT DOCUMENTS

| | | | | |
|---|---|---|---|---|
| 7,333,759 | B2 * | 2/2008 | Kaiho | 399/302 |
| 2008/0261143 | A1 * | 10/2008 | Yamashita | 430/125.3 |
| 2010/0209129 | A1 * | 8/2010 | Kaneko et al. | 399/67 |

* cited by examiner

*Primary Examiner* — Clayton E Laballe

*Assistant Examiner* — Jas Sanghera

(74) *Attorney, Agent, or Firm* — Amin, Turocy & Watson, LLP

(57) ABSTRACT

According to one embodiment, an image forming apparatus includes an image forming unit including an image carrier, a developing device for developing an electrostatic latent image formed on the image carrier using a developing agent containing a decolorable toner and forming a developing agent image, and a transferring and conveying mechanism and a fixing and decolorizing mechanism. In a decolorizing mode, the image carrier and a transfer member are separated in the transferring and conveying mechanism to secure a conveying path to prevent a transfer material from coming into contact with the image carrier. A decolorable image is decolorized at second temperature higher than first temperature in the fixing and decolorizing mechanism.

7 Claims, 7 Drawing Sheets

IMAGE FORMING APPARATUS HAVING DECOLORIZING FUNCTION AND SHEET CONVEYING METHOD IN THE IMAGE FORMING APPARATUS

CROSS-REFERENCE TO RELATED APPLICATIONS

This application is based upon and claims the benefit of priority from U.S. Provisional Application No. 61/552,615, filed on Oct. 28, 2011, the entire contents of which are incorporated herein by reference.

FIELD

Embodiments described herein relate generally to an image forming apparatus used in an electrophotographic method, an electrostatic printing method, a magnetic recording method, and the like and a sheet conveying method in the image forming apparatus.

BACKGROUND

In the past, there is an environmentally friendly technique in which a color of a recording material on paper is erased by heating to enable the paper to be repeatedly used. However, for the environmentally friendly technique, an apparatus that erases an image is necessary separately from an image forming apparatus. Therefore, costs for installing the apparatus increase. Further, complicated work will be required. Therefore, an image forming apparatus imparted with a function of a decolorizing apparatus is proposed. However, the life of the image forming apparatus is reduced by driving during decolorizing.

When the image forming apparatus is used as the decolorizing apparatus, a sheet is discharged from a sheet storing section through a transfer section and a fixing section. If the image forming apparatus performs secondary transfer, when the sheet passes the transfer section, a secondary transfer roller and a transfer belt need to be driven. However, when the transfer belt is driven, the life of a drum is reduced because of friction of the transfer belt and the drum.

DETAILED DESCRIPTION

In general, according to one embodiment, an image forming apparatus having a decolorizing function, the image forming apparatus including: an image carrier; a developing device for developing an electrostatic latent image formed on the image carrier using a developing agent containing a decolorable toner and forming a developing agent image; a transferring and conveying mechanism including a transfer member and configured to press the transfer member against the image carrier and selectively execute processing for transferring the developing agent image onto a transfer material and processing for separating the image carrier and the transfer member and conveying the transfer material without driving the image carrier; and a fixing and decolorizing mechanism configured to selectively execute processing for fixing the developing agent image transferred onto the transfer material at first temperature and forming an image with a decolorable toner and processing for decolorizing an image formed with the decolorable toner at second temperature higher than the first temperature. As the transfer member, a contact transfer device such as a transfer roller or a transfer device of a secondary transfer type is used. The contact transfer device is directly opposed to and in contact with the image carrier. In the transfer device of the secondary transfer type, an intermediate transfer belt is pressed against the image carrier to transfer a toner image on the intermediate transfer belt onto a transfer material.

According to an embodiment, during decolorizing, the transfer member and the image carrier are separated and an image forming unit is not driven. Therefore, it is possible to prevent the wear of the image carrier and extend the life of the image forming apparatus having the decolorizing function.

A plurality of the image forming units can be provided. The developing agent containing the decolorable toner can be applied to a developing device of at least one image forming unit.

The embodiment is more specifically explained below with reference to examples.

Figure 1:
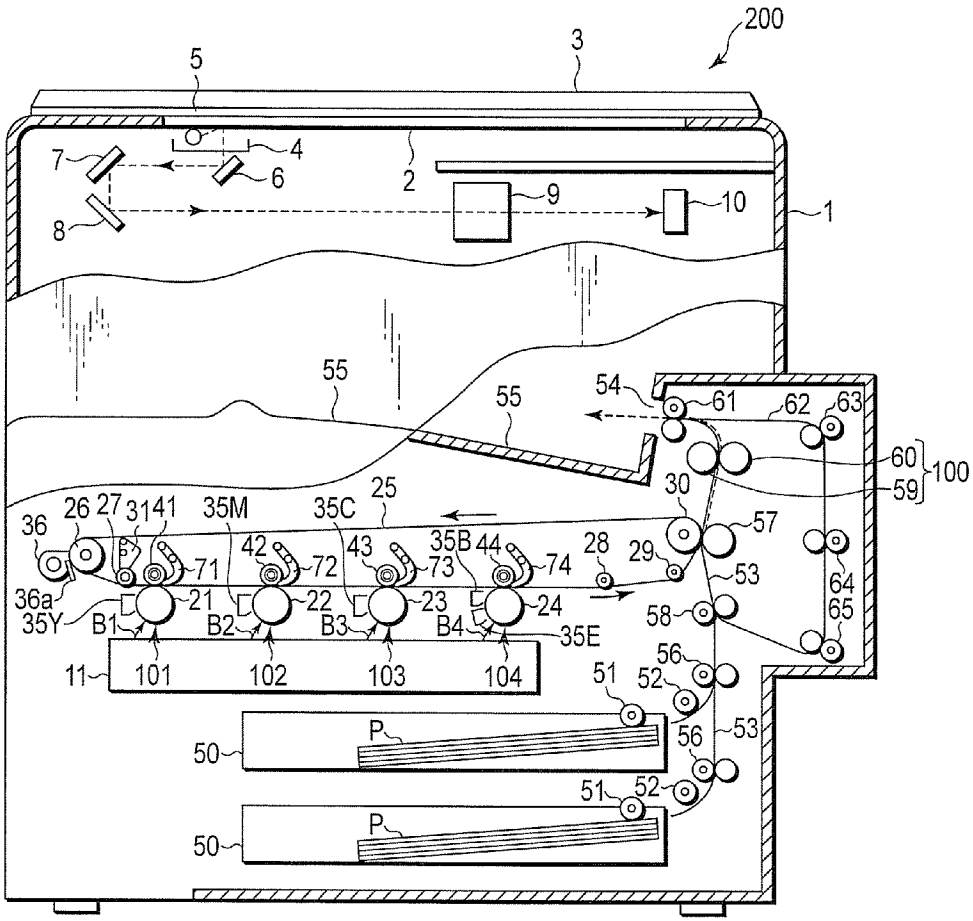
FIG. 1 is an exemplary view showing an image forming apparatus according to an embodiment.

FIG. 1 is schematic diagram showing an example of a color image forming apparatus according to the embodiment.

As shown in FIG. 1, in an image forming apparatus 200, a transparent document table (a glass plate) 2 for placing an original document is provided in an upper part of a main body 1. A cover 3 is openably and closably provided on the document table 2. A carriage 4 is provided on the lower surface side of the document table 2. An exposure lamp 5 is provided in the carriage 4. The carriage 4 can reciprocatingly move along the lower surface of the document table 2. The exposure lamp 5 is lit while the carriage 4 moves forward, whereby an original document D on the document table 2 is exposed to light. According to the exposure, a reflected light image of the original document D placed on the document table 2 is obtained. The reflected light image is projected on a CCD (Charge Coupled Device) 10 by reflection mirrors 6, 7, and 8 and a lens block for magnification 9. The CCD 10 outputs an image signal corresponding to the reflected light image of the original document D.

The carriage 4, the exposure lamp 5, the reflection mirrors 6, 7, and 8, the lens block for magnification 9, and the CCD 10 configure a scan unit that optically reads an image of the original document D placed on the document table 2.

The image signal output from the CCD 10 is appropriately processed and then supplied to an exposing unit 11. The exposing unit 11 emits a laser beam B1 corresponding to an image signal of a yellow color, a laser beam B2 corresponding to an image signal of a magenta color, a laser beam 33 corresponding to an image signal of a cyan color, and a laser beam 34 corresponding to an image signal of a black color respectively to a photoreceptor drum 21 for the yellow color, a photoreceptor drum 22 for the magenta color, a photoreceptor drum 23 for the cyan color, and a photoreceptor drum 24 for the black color or for the decolorable toner.

The photoreceptor drums 21, 22, 23, and 24 are arrayed substantially in a horizontal direction at a fixed interval. A transfer belt 25 is provided above the photoreceptor drums 21, 22, 23, and 24. The transfer belt 25 is laid over a drive roller 26, guide rollers 27, 28, and 29, and a driven roller 30. The transfer belt 25 receives motive power from the drive roller 26 and rotates to travel in the counterclockwise direction. The guide roller 27 is provided to be capable of moving up and down. The guide roller 27 is moved to the transfer belt 25 side by receiving pivoting of a cam (a third cam) 31 to thereby displace the transfer belt 25 to the photoreceptor drums 21, 22, 23, and 24 side.

In a transfer section, primary transfer rollers 41, 42, 43, and 44 are provided to be capable of moving up and down in positions opposed to the photoreceptor drums 21, 22, 23, and 24 across the transfer belt 25. The primary rollers 41, 42, 43, and 44 are moved (lowered) to the transfer belt 25 side to thereby bring the transfer belt 25 into contact with the photoreceptor drums 21, 22, 23, and 24 and transfer visible images on the photoreceptor drums 21, 22, 23, and 24 onto the transfer belt 25.

FIG. 1 shows a state in which all the primary transfer rollers 41, 42, 43, and 44 move to the transfer belt 25 side (in the downward direction) and the transfer belt 25 is in contact with all the photoreceptor drums 21, 22, 23, and 24 (hereinafter referred to as image forming mode).

Figure 2:
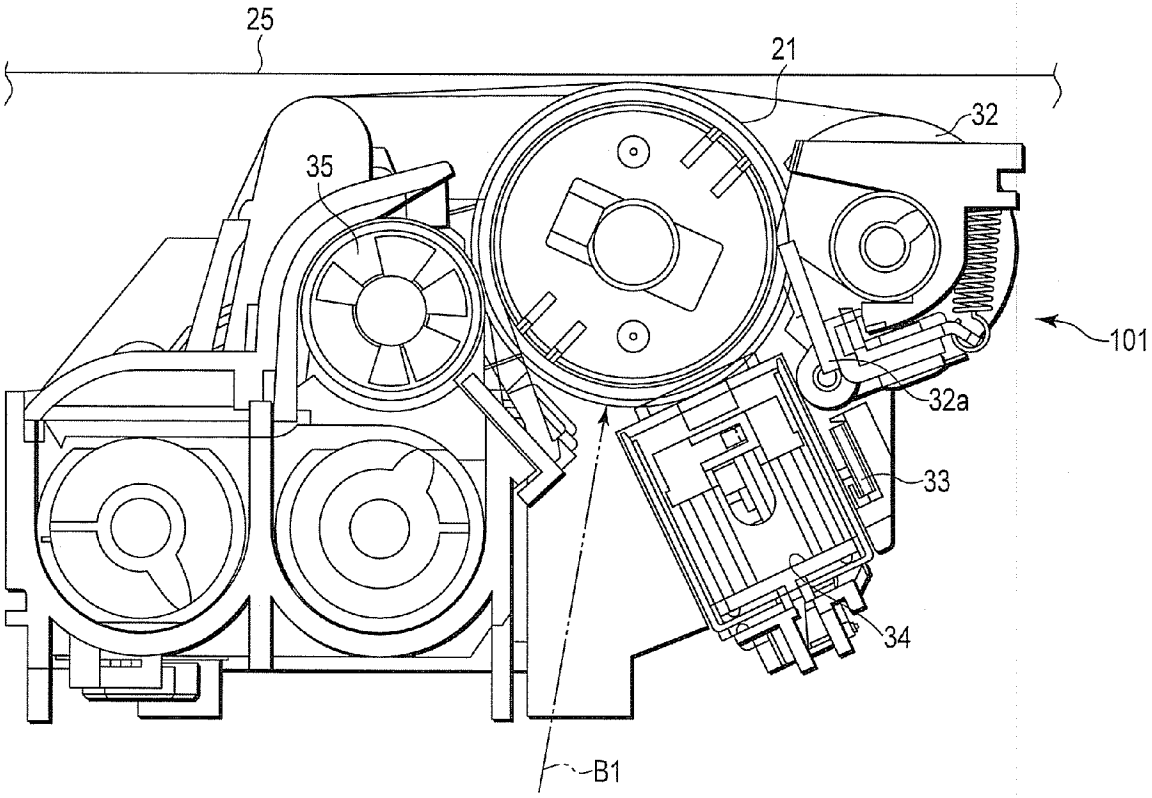
FIG. 2 is a diagram showing the configuration of a part of an image forming unit shown in FIG. 1.

An example of the configuration of an image forming unit shown in FIG. 1 including the photoreceptor drum 21 and a peripheral section of the photoreceptor drum 21 is shown in FIG. 2.

In an image forming unit 101, a cleaner 32, a charge removing lamp 33, a charging unit 34, and a developing unit 35Y are sequentially disposed around the photoreceptor drum 21. The cleaner 32 includes a cleaning blade 32*a* that is in contact with the surface of the photoreceptor drum 21. The cleaner 32 scrapes off, with the cleaning blade 32*a*, a developing agent remaining on the surface of the photoreceptor drum 21. The charge removing lamp 33 removes charges remaining on the surface of the photoreceptor drum 21. The charging unit 34 applies a high voltage to the photoreceptor drum 21 to thereby charge the surface of the photoreceptor drum 21 with static charges. The laser beam B1 emitted from the exposing unit 11 is irradiated on the surface of the charged photoreceptor drum 21. An electrostatic latent image is formed on the surface of the photoreceptor drum 21 by the irradiation. The developing unit 35Y supplies a developing agent (a toner) of the yellow color to the surface of the photoreceptor drum 21 to thereby visualize the electrostatic latent image on the surface of the photoreceptor drum 21.

The configuration of an image forming unit 102 including the photoreceptor drum 22 and a peripheral section of the photoreceptor drum 22 and the configuration of an image forming unit 103 including the photoreceptor drum 23 and a peripheral section of the photoreceptor drum 23 are the same as the configuration of the image forming unit 101 except that a developing unit 35M and a developing unit 35C are respectively used instead of the developing unit 35Y. Therefore, explanation of the configurations is omitted.

The configuration of an image forming unit 104 including the photoreceptor drum 24 and a peripheral section of the photoreceptor drum 24 is the same as the configuration of the image forming unit 101 except that a developing unit 35B for the black color and a developing unit 35E for the decolorable toner are provided instead of the developing unit 35Y and the use of the two developing units 35B and 35E can be controlled according to image information.

As an example of the decolorable toner, a toner that is fixed at first temperature of 80° C. to 100° C. and decolorized by being heated to second temperature of 130° C. to 150° C. is used.

In this embodiment, as the decolorable toner, a capsule type heat decolorable toner formed by a chemical method explained below is used.

(1) Binder Resin and Wax Atomized Liquid

Polyester resin was used as binder resin. Resin atomized liquid was produced using a high-pressure homogenizer from the polyester resin, an anionic emulsifier, and a neutralizer.

(2) Preparation of Wax Dispersed Liquid

Atomized liquid was obtained by the same method as the method for the resin using rice wax.

(3) Preparation of a Toner

Leuco dye: CVL (crystal violet lactone), a color developing agent: benzyl 4-hydroxybenzonate, and a temperature control agent: lauric acid-4-benzyloxyphenylethyl were heated and melted and encapsulated by a well-known coacervation method. An encapsulated color material, toner binder resin dispersed liquid, and the wax dispersed liquid were condensed and fused using aluminum sulfate ($Al_2(SO_4)_3$) and were cleaned and dried, whereby a toner was obtained. Silica and titanium oxide were externally added to the toner.

A plurality of paper feeding cassettes 50 are provided as a sheet storing section below the exposing unit 11. A large number of sheets (paper sheets) P of sizes different from one another are stored in the paper feeding cassettes 50. The sheets P are extracted one by one from any one of the paper feeding cassettes 50. Pickup rollers 51 are provided in the paper feeding cassettes 50 as rollers for extracting the sheets P. The extracted sheets P are respectively separated from the paper feeding cassettes 50 by separation rollers 52 and supplied to a conveying path 53.

The conveying path 53 extends to a discharge port 54 in an upper part through the driven roller 30. The paper discharge port 54 faces a paper discharge tray 55 that extends to the outer circumferential surface of the main body 1.

On a start end side of the conveying path 53, paper feeding rollers 56 are respectively provided in the vicinities of the separation rollers 52. Further, a secondary transfer roller 57 is provided across the transfer belt 25 in a position opposed to the driven roller 30 in substantially a middle part of the conveying path 53. A registration roller 58 is provided in a position further on the upstream than the driven roller 30 and the secondary transfer roller 57 in the conveying path 53. The registration roller 58 sends the sheet P into between the transfer belt 25 and the secondary transfer roller 57. The secondary transfer roller 57 transfers a visible image transferred on the transfer belt 25 onto the sheet P while holding the sheet P sent from the registration roller 58 between the secondary transfer roller 57 and the transfer belt 25 on the driven roller 30.

In the conveying path 53, a heat roller 59 for heat fixing and a press contact roller 60 that is in contact with the heat roller 59 are provided in a position further on the downstream side than the secondary transfer roller 57. A paper discharge roller 61 is provided at the terminal end of the conveying path 53.

The temperature of the heat roller 59 is set to, for example, first temperature 100° C. lower than second temperature 130° C. of the heat roller 59 in a decolorizing mode. An image transferred onto the sheet P is fixed at the temperature.

A conveying path 62 for reversing the front and the rear of the sheet P is provided from the terminal end of the conveying path 53 to an upstream side position of the registration roller 58. Paper feeding rollers 63, 64, and 65 are provided in the conveying path 62. The sheet P that reaches the terminal end of the conveying path 53 is returned to the conveying path 53 through the conveying path 62, whereby the visible image on the transfer belt 25 is transferred onto the rear side of the sheet P as well.

On the other hand, a cleaner 36 is provided across the transfer belt 25 in a position opposed to the drive roller 26. The cleaner 36 includes a cleaning blade 36*a* that is in contact with the transfer belt 25. The cleaner 36 scrapes off, with the cleaning blade 36*a*, the developing agent remaining on the transfer belt 25.

Figure 3:
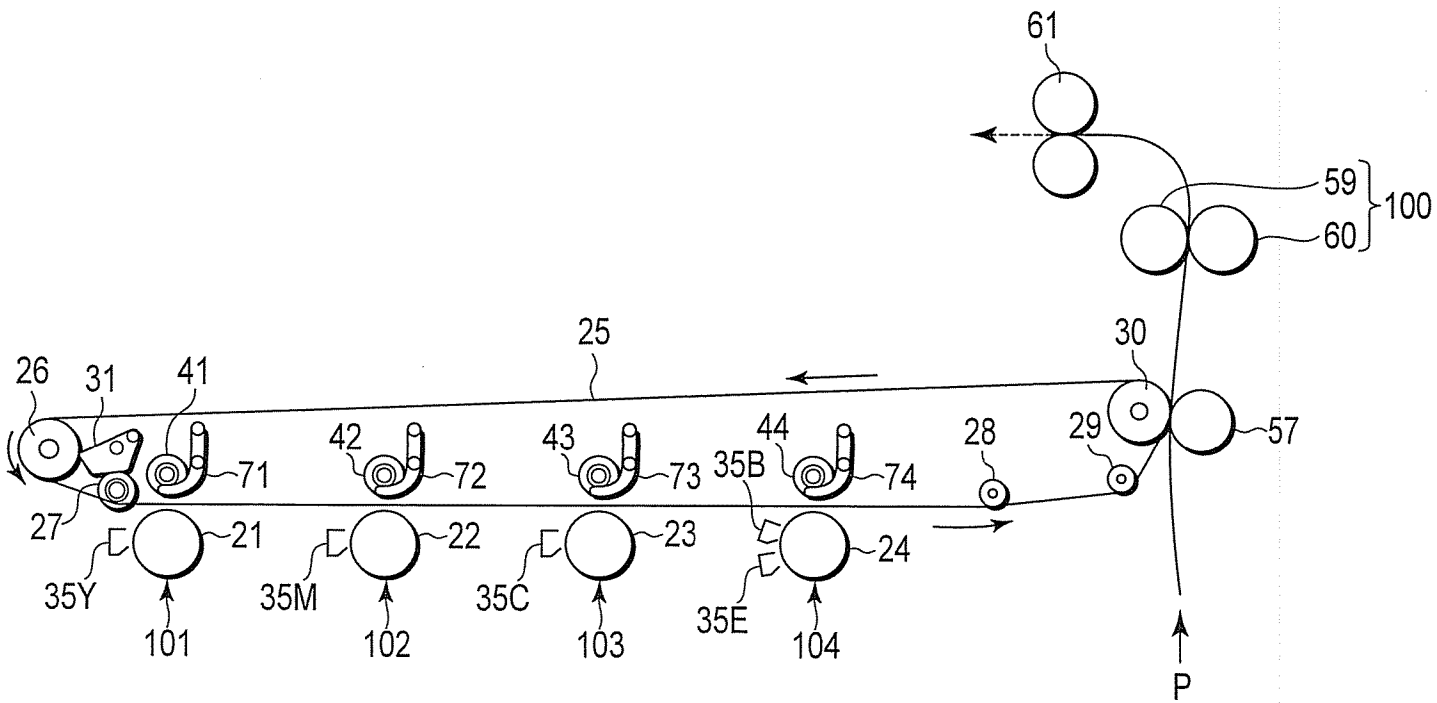
FIG. 3 is a diagram for explaining the operations of image forming units and a fixing and decolorizing mechanism shown in FIG. 1.

FIG. 3 is a diagram showing the image forming units and the fixing and decolorizing mechanism in the decolorizing mode.

Hooks 71, 72, 73, and 74 are provided in the vicinities of the primary transfer rollers 41, 42, 43, and 44. As shown in FIG. 3, the hooks 71, 72, 73, and 74 engage with shafts of the primary transfer rollers 41, 42, 43, and 44 while pivoting and lift the shafts to thereby move the primary transfer rollers 41, 42, 43, and 44 to separate from the photoreceptor drums 21, 22, 23, and 24 and separate the transfer belt 25 from the photoreceptor drums 21, 22, 23, and 24.

As shown in the figure, all the hooks 71, 72, 73, and 74 pivot and the primary transfer rollers 41, 42, 43, and 44 move to the opposite side (in the upward direction) of the transfer belt 25. The transfer belt 25 moves in a state in which the transfer belt 25 is separated from all the photoreceptor drums 21, 22, 23, and 24. In the conveying path 53, the sheet P having a decolorable image formed thereon is sent into between the transfer belt 25 and the secondary transfer roller 57 and is led into a fixing and decolorizing mechanism 100 provided in a position on the downstream side of the secondary transfer roller 57. The heat roller 59 and the press contact roller 60 that is in contact with the heat roller 59 are provided in the fixing and decolorizing mechanism 100. The temperature of the heat roller 59 is set to, for example, the second temperature 130° C. higher than the first temperature 100° C. of the heat roller 59 in the image forming mode. The image is decolorized in the fixing and decolorizing mechanism 100.

The image forming apparatus 200 can form an image by selecting any one of a mode for forming an image only with a decolorable toner (hereinafter referred to as decolorable toner single-color mode), a mode for forming an image by combining the decolorable toner and non-decolorable toners (hereinafter referred to as mixed mode), and a mode for forming an image only with the non-decolorable toners (hereinafter referred to as non-decolorable toner single-color mode or non-decolorable toner color mode).

Switching of these modes is performed by, for example, a user inputting an instruction from a not-shown control panel.

In the decolorable toner single-color mode, the developing unit 35E is used. In other words, an image is formed with a blue decolorable toner.

In the mixed mode, an image is formed by one to three image forming units selected out of the image forming units 101, 102, and 103 and the image forming unit 104. In other words, an image is formed by combining toners of one to three colors selected out of yellow, magenta, and cyan and the blue decolorable toner. For example, when the blue decolorable toner is set to reach the second temperature when being fixed by the fixing and decolorizing mechanism 100, the blue toner is decolorized and cannot be seen on a sheet.

The decolorable toner is used for recording information concerning image formation such as a date of formation of an image on a sheet and a serial number of an image forming apparatus. If such information is recorded in an invisible form, it is possible to cool the sheet and develop a color of the decolorable toner when such information is necessary later. The recording with the decolorable toner is desirably performed, for example, at an end of the sheet to prevent the decolorable toner from overlapping the non-decolorable toners.

If an image is formed only with the non-decolorable toners, the image is formed by one to four image forming units selected out of the image forming units 101, 102, and 103 and the image forming unit 104 including the developing unit 35B. In other words, an image of a single color selected out of yellow, magenta, cyan, and black or a color image of two to four colors selected out of these colors is formed.

The image forming units 101, 102, and 103 do not operate in the decolorable toner single-color mode and in a black toner single-color mode of the non-decolorable toner single-color mode.

Figure 4:
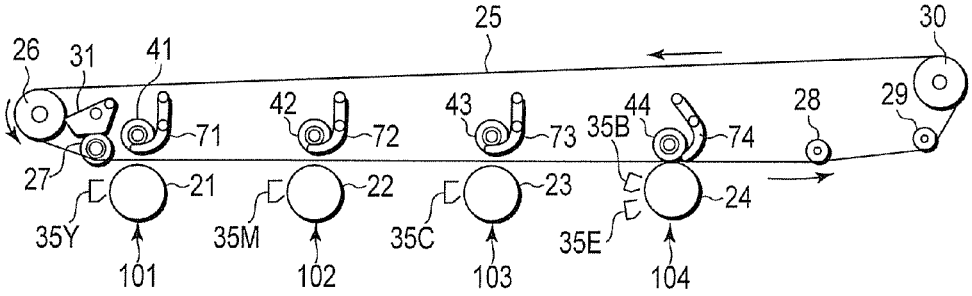
FIG. 4 is a diagram for explaining an example of the operation of the image forming units shown in FIG. 1.

FIG. 4 is a diagram for explaining an example of the operation of the image forming units shown in FIG. 1.

In the decolorable toner single-color mode and the black toner single-color mode, for example, as shown in FIG. 4, only the hooks 71, 72, and 73 pivot, the primary transfer rollers 41, 42, and 43 move to the opposite side (in the upward direction) of the transfer belt 25, and the primary transfer roller 44 stays on the transfer belt 25 side. The transfer belt 25 can be in contact with only the photoreceptor drum 24 for the black color and for the decolorable toner.

The transfer belt 25 receives the pivoting of the cam 31 and moves. The transfer belt 25 can be set in contact with only the photoreceptor drum 24. Consequently, the image forming units 101, 102, and 103 are not unnecessarily driven. The wear of the photoreceptor drums 21, 22, and 23, the intermediate transfer belt 25, and the like is prevented.

The configuration for engaging the hooks with the shafts of the primary transfer rollers and lifting the shafts is an example of a mechanism for separating the transfer belt and the photoreceptor drums. Other configurations can be used as long as the transfer belt and the photoreceptor drums can be separated.

The image forming apparatus having the decolorizing function includes the sheet storing section, the transfer section, the fixing and decolorizing mechanism, and the mechanism for separating the transfer belt and the photoreceptor drums. The sheet is sent from the sheet storing section to the fixing and decolorizing mechanism through the transfer section. When the sheet passes the transfer section in the image forming mode, the transfer belt and the secondary transfer roller need to be driven. However, the transfer belt is in contact with the primary transfer roller and the photoreceptor drum while being held between the primary transfer roller and the photoreceptor drum. When the transfer belt is driven, the photoreceptor drum is also driven at equal speed. If the image forming apparatus is used as the decolorizing apparatus, since an image is not formed, it is unnecessary to drive an EPU. Since the EPU is not driven, it is possible to prevent friction of the cleaning blades of the photoreceptor drums and the developing agent. However, if only the transfer belt is driven in a state in which the photoreceptor drums are stopped, friction of the photoreceptor drums and the transfer belt is large and the photoreceptor drums and the transfer belt damage each other. Therefore, in the image forming apparatus having the decolorizing function according to the embodiment, if the image forming apparatus is used in the decolorizing mode, the transfer belt and the photoreceptor drums are separated and the EPU is not driven.

If an image is formed by combining the decolorable toner and the non-decolorable toners, it is possible to erase only an image portion formed with the decolorable toner without changing an image portion formed with the non-decolorable toners. Therefore, applications of the image forming apparatus in which the non-decolorable toners and the decolorable toner are used increase. However, all the developing devices for Y, M, C, and K may include only decolorable toners without including a non-decolorable toner.

Figure 5:
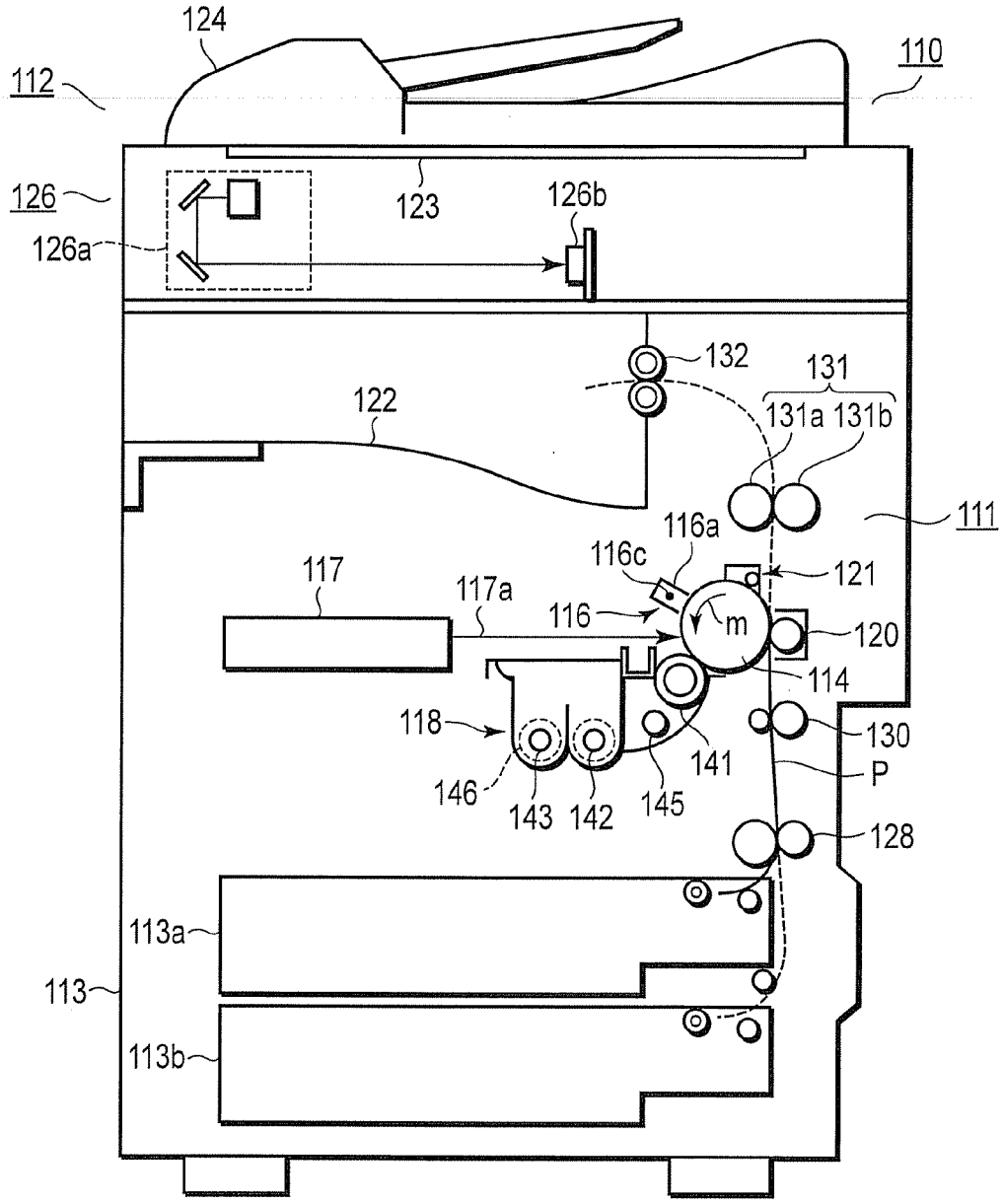
FIG. 5 is a schematic diagram showing an example of a single-color image forming apparatus.

FIG. 5 is a schematic diagram showing an example of a single-color image forming apparatus according to an embodiment.

In FIG. 5, a copying machine 110 includes a printer section 111, a scanner section 112, and a paper feeding section 113.

The printer section 111 includes an image forming unit.

The image forming unit includes a photoreceptor drum 114 that is an image carrier and rotates in an arrow m direction, an electrifying charger 116 that is provided around the photoreceptor drum 114 and uniformly charges the photoreceptor drum 114, and a laser exposing device 117 that irradiates a laser beam 117*a* on the charged photoreceptor drum 114 on the basis of image data or the like from the scanner section 112 and forms an electrostatic latent image on the photoreceptor drum 114. The electrifying charger 116 includes a grid on a surface of a case 116*b*, which supports a charge wire 116*a*, opposed to the photoreceptor drum 114. The electrifying charger 116 and the laser exposing device 117 configure latent image forming means. Further, the image forming unit includes, around the photoreceptor drum 114, a developing device 118 functioning as developing means for developing and visualizing the electrostatic latent image on the photoreceptor drum 114.

The developing device 118 includes, in a case 140, a developing roller 141, a developing agent supplying mixer 145, a first mixer 142, and a second mixer 143. The developing device 118 performs development using a decolorable developing agent 146. Further, the image forming unit includes a transfer roller 120 functioning as transfer means for coming into contact with sheet P, which is a recording medium, and transferring a toner image formed on the photoreceptor drum 114 onto the sheet P and a blade cleaner 121 functioning as cleaning means. For example, the scanner section 112 arranged above the printer section 111 via a paper discharge section 122 includes a scanner device 126 that reads an original document placed on a document glass 123 or an original document conveyed by an auto document feeder (ADF) 124. The scanner device 126 includes an optical mechanism 126*a* that optically reads a document image and a photoelectric conversion element (CCD: charge coupled device) 126*b* that converts an optical signal from the optical mechanism 126*a* into an electric signal.

The paper feeding section 113 below the printer section 111 includes first and second paper feeding cassettes 113*a* and 113*b*. A conveying roller 128 and a registration roller 130 are provided between the paper feeding section 113 and the photoreceptor drum 114. The registration roller 130 conveys the sheet P to between the photoreceptor drum 114 and the transfer roller 120 in synchronization with the toner image on the photoreceptor drum 114. A fixing roller 131 and a paper discharge roller 132 are provided between the photoreceptor drum 114 and the paper discharge section 122. The fixing roller 131 nips and conveys the sheet P having the toner image transferred thereon by the transfer roller 120 and heats and pressurizes the toner image to fix the toner image on the sheet P. The paper discharge roller 132 discharges the sheet P to the paper discharge section 122 after the fixing.

In an image forming process, a toner image is formed on the photoreceptor drum 114 according to image data input from the scanner device 126, a personal computer terminal, or the like. The toner image on the photoreceptor drum 114 is transferred onto the sheet P by the transfer roller 120. Thereafter, the sheet P passes a fixing device 131 including a heat roller 131*a* and a pressurizing roller 131*b* to have the toner image fixed thereon. The sheet P is discharged to the paper discharge section 122. After the transfer ends, the photoreceptor drum 114 passes the blade cleaner 121 and a residual toner on the photoreceptor drum 114 is removed. Then, the image forming process ends.

Figure 6:
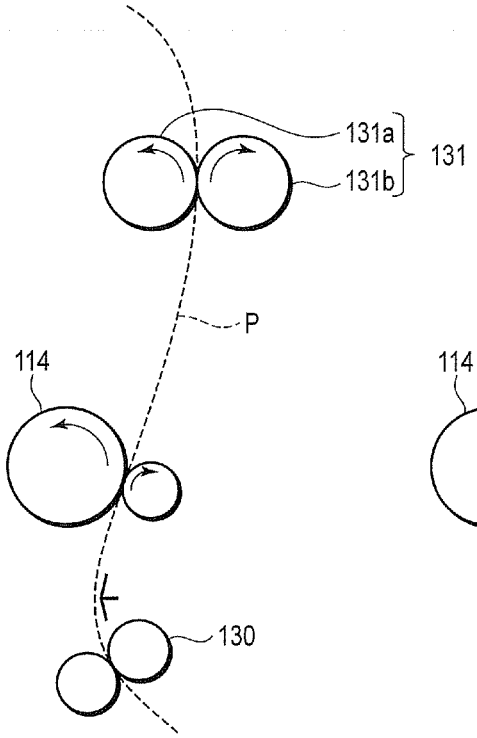
FIG. 6 is a diagram for explaining an example of the operation of an image forming unit shown in FIG. 5.

FIG. 6 is a diagram for explaining an example of an image forming operation of the image forming unit shown in FIG. 5.

The pressurizing roller 131*b* of the fixing device 131 is pressed against the heating roller 131*a* by a spring force to form a nip. Usually, during the image forming operation, as shown in FIG. 6, the photoreceptor drum 114 and the fixing device 131 are respectively independently driven to convey the sheet P and perform image formation, transfer of a developing agent image, and fixing. The registration roller 130 is configured to be driven via a gear or a belt according to the driving of the fixing device 131. The registration roller 130 can be turned on and off by, for example, a clutch. The heating temperature of the heating roller 131*a* is controlled to temperature near 80° C. and the sheet P having the developing agent image transferred thereon is heated in the fixing device 113, whereby the developing agent image is fixed.

Figure 7:
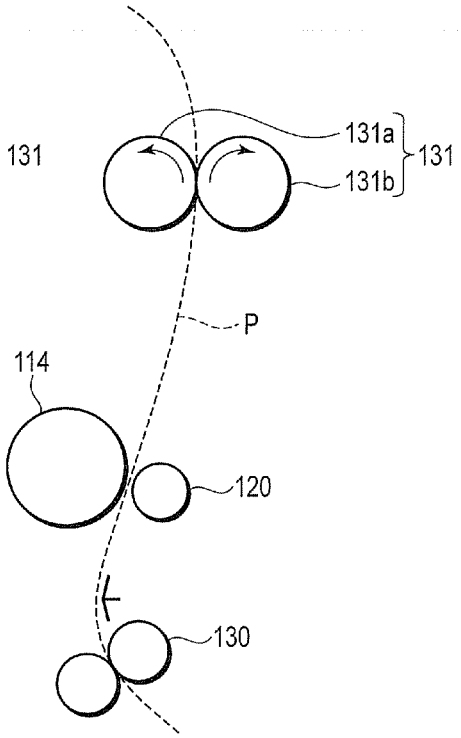
FIG. 7 is a diagram for explaining another example of the operation of the image forming unit shown in FIG. 5.

FIG. 7 is a diagram for explaining another example of the decolorizing operation of the image forming unit shown in FIG. 5. As shown in FIG. 7, the image forming unit includes a contact and separation mechanism for separating the transfer roller from the photoreceptor drum by 0.5 mm or more during the decolorizing operation in the case of contact transfer. It is possible to prevent the sheet P from coming into contact with the photoreceptor drum 114 to secure a sheet conveying path by separating the transfer roller, convey the sheet P having the decolorable image formed thereon to the fixing device 113 in a state in which the driving of the photoreceptor drum 114 is stopped, and heat the sheet P in the fixing device 113 to thereby decolorize the image. Heating temperature in decolorizing the image is controlled to be decolorable temperature, for example, temperature equal to or higher than 100° C.

If fixing driving speed, i.e., sheet conveyance speed during the decolorizing operation is set to speed lower than fixing driving speed during the image forming operation, it is possible to more surely decolorize the image.

Figure 8:
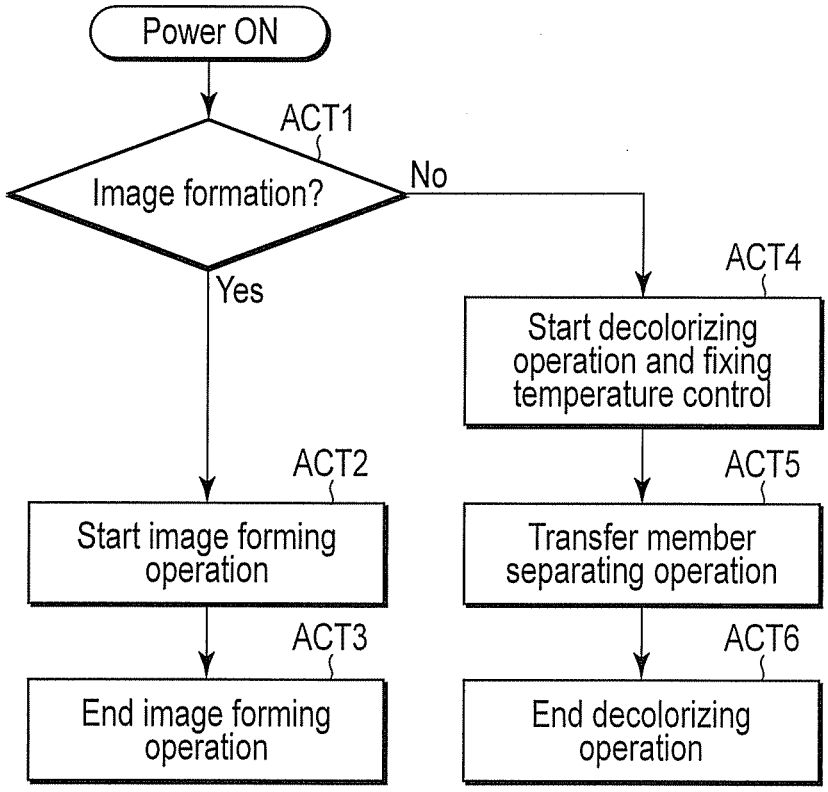
FIG. 8 is a flowchart for explaining a work flow during the operation shown in FIG. 5.

A work flow during operation is shown in FIG. 8.

As shown in the figure, a power supply is turned on. First, it is determined whether the image forming operation is performed (Act 1). If the image forming operation is selected, the image forming operation is started (Act 2). When image formation is completed, the image forming operation is ended (Act 3). If the decolorizing operation is selected, the decolorizing operation and temperature control for the fixing roller are started (Act 4). An operation for separating the transfer member and the photoreceptor drum is performed (Act 5). When decolorization is completed, the decolorizing operation is ended (Act 6).

The respective operations can be executed according to selection of the image forming mode and the decolorizing mode. Fixing speed during the decolorizing operation can be changed to at least at speed equal to or lower than speed during a print operation according to a toner characteristic. This is for preventing decolorization unevenness that could occur because of the toner characteristic. According to the embodiment, since the decolorizing function is imparted to a fixing apparatus, it is possible to eliminate excessive driving of the photoreceptor drum during the decolorizing operation. Therefore, it is possible to prevent the short life of the photoreceptor drum.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus having a decolorizing function, the image forming apparatus comprising:

an image carrier;

a developing device for developing an electrostatic latent image formed on the image carrier using a developing agent containing a decolorable toner and forming a developing agent image;

a transferring and conveying mechanism including a transfer member and configured to press the transfer member against the image carrier and selectively execute processing for transferring the developing agent image onto a transfer material and processing for separating the image carrier and the transfer member and conveying the transfer material without driving the image carrier, wherein the transfer member is a transfer roller; and a fixing and decolorizing mechanism configured to selectively execute processing for fixing the developing agent image transferred onto the transfer material at first temperature and forming an image and processing for decolorizing an image formed with the decolorable toner at second temperature higher than the first temperature.

2. The apparatus according to claim 1, wherein conveying speed of the transfer material during decolorization is lower than conveying speed of the transfer material during image formation.

3. An image forming apparatus having a decolorizing function, the image forming apparatus comprising:

an image carrier;

a developing device for developing an electrostatic latent image formed on the image carrier using a developing agent containing a decolorable toner and forming a developing agent image;

a transferring and conveying mechanism including a transfer member and configured to press the transfer member against the image carrier and selectively execute processing for transferring the developing agent image onto a transfer material and processing for separating the image carrier and the transfer member and conveying the transfer material without driving the image carrier; and a fixing and decolorizing mechanism configured to selectively execute processing for fixing the developing agent image transferred onto the transfer material at first temperature and forming an image and processing for decolorizing an image formed with the decolorable toner at second temperature higher than the first temperature, wherein the transfer member includes a transfer belt onto which the developing agent image is primarily transferred, a primary transfer member configured to press the transfer belt against the image carrier, and a second transfer member configured to transfer the developing agent image on the transfer belt onto the transfer material, and the transferring and conveying mechanism selectively executes the processing for transferring the developing agent image onto the transfer material and processing for separating the transfer belt and the primary transfer member from the image carrier and conveying the transfer material without driving the image carrier.

4. The apparatus according to claim 3, wherein a plurality of image forming units are provided, wherein image forming units comprise the image carrier and the developing device, respectively.

5. The apparatus according to claim 3, wherein conveying speed of the transfer material during decolorization is lower than conveying speed of the transfer material during image formation.

6. An image forming apparatus having a decolorizing function, the image forming apparatus comprising:

an image carrier;

a developing device for developing an electrostatic latent image formed on the image carrier using a developing agent containing a decolorable toner and forming a developing agent image;

a transferring and conveying mechanism including a transfer member and configured to press the transfer member against the image carrier and selectively execute processing for transferring the developing agent image onto a transfer material and processing for separating the image carrier and the transfer member and conveying the transfer material without driving the image carrier; and a fixing and decolorizing mechanism configured to selectively execute processing for fixing the developing agent image transferred onto the transfer material at first temperature and forming an image and processing for decolorizing an image formed with the decolorable toner at second temperature higher than the first temperature, wherein conveying speed of the transfer material during decolorization is lower than conveying speed of the transfer material during image formation.

7. The apparatus according to claim 6, wherein a plurality of image forming units are provided, wherein image forming units comprise the image carrier and the developing device, respectively.

* * * * *

UNITED STATES PATENT AND TRADEMARK OFFICE

CERTIFICATE OF CORRECTION

PATENT NO. : 8,874,020 B2
APPLICATION NO. : 13/660166
DATED : October 28, 2014
INVENTOR(S) : Katsutoshi Mita and Yoshinori Sanmonji It is certified that error appears in the above-identified patent and that said Letters Patent is hereby corrected as shown below:

On the title page, item (72), line 2,

Katsutoshi Mita, Izu (JP); Yoshinori Sammonji, Yokohama (JP)

should read:

Katsutoshi Mita, Izu (JP); Yoshinori Sanmonji, Yokohama (JP)

Signed and Sealed this
Twenty-fourth Day of March, 2015

Michelle K. Lee

Michelle K. Lee
*Director of the United States Patent and Trademark Office*